United States Patent [19]

Latowski et al.

[11] 4,289,485

[45] Sep. 15, 1981

[54] SINTER MACHINE-PELLETIZING MACHINE WEAR AND BAFFLE PLATE FOR PALLET SIDE PLATE

[75] Inventors: Anthony A. Latowski, Pittsburgh; William P. Grib, Belle Vernon, both of Pa.

[73] Assignee: Koppers Company, Inc., Pittsburgh, Pa.

[21] Appl. No.: 66,551

[22] Filed: Aug. 15, 1979

[51] Int. Cl.[3] ..... F27D 3/00

[52] U.S. Cl. ..... 432/245; 266/178; 266/279; 432/137; 432/241

[58] Field of Search ..... 432/137, 241, 245, 253; 266/178, 279

[56] References Cited

U.S. PATENT DOCUMENTS

| | | | |
|---|---|---|---|
| 2,989,395 | 6/1961 | Meyer | 266/178 |
| 2,997,287 | 8/1961 | Boron | 432/241 |
| 3,384,355 | 5/1968 | Ban | 432/241 |
| 3,559,967 | 2/1971 | Werner | 432/245 |
| 3,824,071 | 7/1974 | Lovold | 432/241 |

*Primary Examiner*—John J. Camby

*Attorney, Agent, or Firm*—Donald M. MacKay

[57] ABSTRACT

There is disclosed a traveling grate apparatus wherein materials are treated at an elevated temperature for purposes such as sintering, pelletizing, calcining, and the like. In such apparatus, a grate and upstanding side plates form a channel for carrying the material along. Each side plate has along its inner face a bench for holding the material to be treated. As the treatment of material effects changes in the volume of the material, the material tends to lose contact with the side wall, but, by resting on the bench, a seal is provided to prevent direct passage of gases through the bed in the sidewall sections.

4 Claims, 2 Drawing Figures

SINTER MACHINE-PELLETIZING MACHINE WEAR AND BAFFLE PLATE FOR PALLET SIDE PLATE

BACKGROUND OF THE INVENTION

1. Field of the Invention

This invention relates generally to furnaces of the traveling grate type wherein materials such as iron ore, and the like, are pelletized and/or sintered at elevated temperatures and, more particularly, to the minimizing of the air flow at the interface of the material and the sidewalls of the traveling grate and to the protecting of the sidewalls of the traveling grates of the furnace from severe temperature conditions during the processing of the material carried by the grates.

2. Prior Art

The individual pallet frames that make up the continuous traveling bed or heating or sintering bed of the traveling grate machines are fitted with steel or ductile iron side plates. These side plates are to provide a sidewall to retain a considerable thickness of the material that is to be sintered, dried or pelletized. These side plates are to be intricately cast and machined so that mating surfaces of the preceeding and trailing pallet side plate assemblies will prevent air leakage and consequent bypassing of the desired air flow through the material. However, the high temperatures and erosion encountered during the heating process, and particularly the adverse effect of the ignition furnace, tend to cause this carefully-machined seal or mating surface to be quickly and easily lost. The resulting warping, cracking, distortion and wear permits air to bypass through the openings in the vertical sidewalls. Energy is thus wasted and at some locations the material or the bed will be subjected to conditions different than other locations insofar as the heating, sintering, drying or calcining conditions are concerned.

Shields have been proposed to protect the side plates from the deleterious effects of temperature. These shields are usually expendable, so they can be replaced whenever they have deteriorated to the extent that they are no longer protecting the sidewalls. Typical shields are those described in U.S. Pat. Nos. 3,559,967 and 3,384,355.

As the moist, powdered or granular material heats, dries, fuses and/or melts, the volume of the material changes. The material tends to pull away from the sides of the grate and this creates a problem of improperly heating or sintering the material next to the sidewalls of the pallets. U.S. Pat. No. 3,824,071 proposes to solve this problem by having inwardly- and downwardly-sloping side plate members fastened along the vertical sidewall member. Such sloping side plate members also have openings for the passage of hot gases so as to promote the heating of the material in process adjacent to the sloping sidewall members. It is the expectation of U.S. Pat. No. 3,824,071 that, as the volume of the material being treated changes, the bed of material will move lower along the wall but, due to the slope of the wall, still maintain a material to wall contact.

SUMMARY OF THE INVENTION

In accordance with this invention, the sidewall of the traveling grate has a cross-sectional profile that is J-shaped. The resulting bench then provides resting location for the material being treated. Should the material being treated change in volume and pull away from the sidewall and lose interface contact above or below the bench, the material resting on the bench remains in interface contact with the wall and thus provides a seal to prevent the passage of air between the sidewall and material where contact may have been lost.

Conventionally, the bench may be provided as a portion of a shield which is in the nature of a separate inner liner and baffle plate for protecting the side plate by keeping the heat and erosion from the side plate. Such shield may be a coarse, loosely-fitting casting which requires no particular amount of machining; it may be loosely mounted to the side plate to avoid heat and mechanical stresses; and it need not form any pallet-to-pallet seal so is easily changed at a low replacement cost compared to the conventional side plate. However, the liner conforms in general dimension and shape to the side plate so as to completely shield the side plate from the ignition furnace and thus isolate the heat and erosion of the sintering flame front from the side plate by an air barrier, thereby reducing heat transfer to both the side plate and the pallet frame. A novel feature of this lining plate is that it is cast with a special ledge, thereby forming a bench to provide a labyrinth seal against the free flow of air between the material and the sidewall, thus substantially reducing air and heat leakage.

DESCRIPTION OF THE PREFERRED EMBODIMENT

Figure 2:
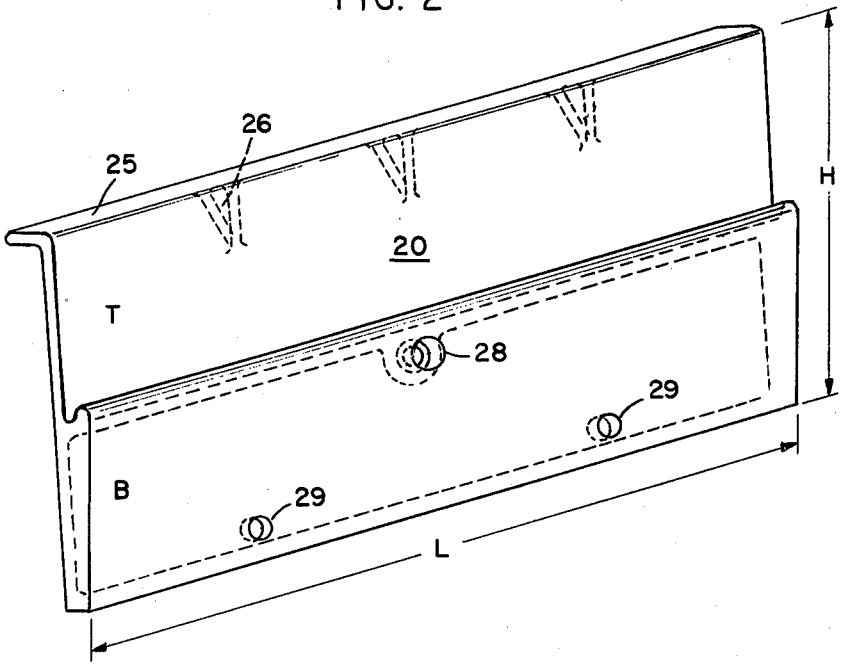
FIG. 2 is an isometric view of the embodiment of the heat shield of FIG. 1
Figure 1:
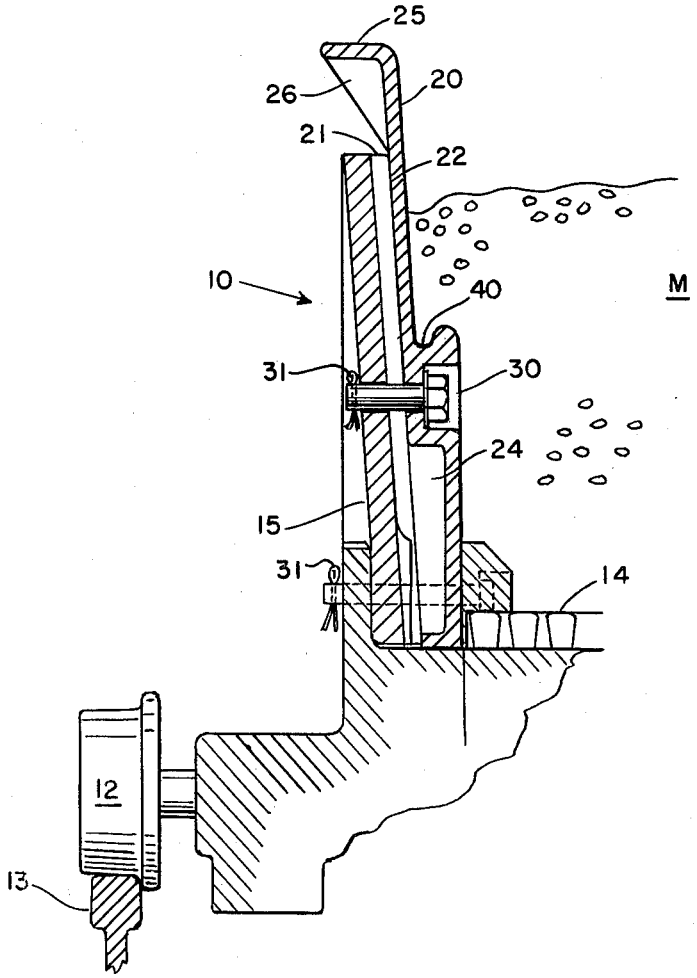
FIG. 1 is a sectional side view of one side of a pallet incorporating an embodiment of the invention shown as a heat shield.

For convenience of description, the embodiment of the novel heat invention is illustrated as a heat shield in connection with the pallet of a generally straight line type of horizontal traveling grate sintering apparatus. The grate comprises a number of abutting pallets 10. Each pallet has wheels 12 that roll on rail 13, a gas-permeable hearth portion comprised of grate bars 14 and upstanding side plate 15 that, with corresponding parts of the abutting pallets, define a channel-shaped cross section for carrying the material (M) which is being heated. Side plates 15 are carefully cast and machined to provide mating surfaces for carefully fitting with the preceeding and trailing side plates to prevent any air leakage therebetween or the bypass of the desired flow of air through the material. The movement of the grate, the heat and erosion of the heat-treating process, and, in particular, the adverse effect of the ignition furnace, tend to cause warping, cracking or distortion of the side plates 15.

In the embodiment of the heat shield 20 as illustrated herein only the top 21 and inner faces 22 of the side plates 15 are shielded. The hot gases generally pass downwardly through the material resting on the grate and these faces tend to receive the greatest exposure to adverse conditions.

The heat shield 20 may be of any suitable heat-resisting material such as steel, iron or refractory material. Shield 20 may, for example, be a coarse, loosely-fitting casting which needs no machining. It can be loosely mounted to avoid heat and mechanical stresses. It need not effect a pallet-to-pallet seal. Thus, it is easily changed at a low replacement cost. It isolates the heat and erosion of the sintering flame front from the side plate by an air barrier 24, thus reducing heat transfer to both the side plates and the pallet frame. The shield, being loosely mounted, is free to expand, contract, warp and corrode. Since it is loosely hung, the operation of the machine is not seriously affected when the shield warps. In any event, as soon as an individual shield is ruined, it can be easily replaced.

Referring now to FIG. 2, the shield 20 is generally rectangular. The length (L) of the shield in the direction of travel of the grate corresponds generally to the length of the face of the side plate 15. The height (H) is at least the height of the side plate 15, and preferably higher, so that top 25 can overlap the top 21 of the side plate to provide additional protection for the side plate. Reinforcing elements 26 for top 21 are provided at selective points along the length of the shield. Apertures 28 and 29 at locations corresponding to apertures in the side plate permit the shield to be loosely joined to the side plate, as by bolt 30 and holding pins 31, respectively. A recess space at the back forms with side 15 the air space 24.

In operation, the material (M), which may be powder, granules, or green pellets that is to be sintered or dried, calcined or otherwise treated at elevated temperature, is placed on the bed that is constituted by the channel formed by the grate 14 and side 15. The bed of material travels forwardly and continuously through the heating zone. With the change in temperature, the volume of the material tends to decrease. The material tends to pull away from the sidewalls of the machine so the contact at the interface of the material and the sidewall tends to disappear. As the material pulls away, channels form where the side wall and the material interface and there is a tendency for air to leak upwardly through these channels.

In accordance with this invention, a bench seat 40 is provided on the inner side of the shield between the upper portion (T) and the lower portion (B) of the inner wall. This bench seat, having a J-shaped crosssectional profile, extends horizontally and provides an auxiliary resting surface for the material being heated. Thus, should the material shrink in volume and pull away from either the upper portion (T) or the lower portion (B) of the inner wall, the material is still in contact with and resting on one supported by the bench seat. Therefore, no continuous loss of interface contact from the bottom to the top of the material occurs, as loss is stopped at the bench seat. Any tendency for a continuous gas leakage from top to bottom of the bed of material is thus inhibited and any loss of interface does not proceed through the barrier which is formed by the material being supported on the bench seat.

It is evident from the foregoing that the bench provides in effect a labyrinth seal against the free flow of air through the material on the bed from the top to the bottom at the side plates. While the amount of air leaking at such location is difficult to determine, the estimate is that this invention will reduce by more than 60 percent the tendency for air to leak. At the same time, the novel shield reduces the machine maintenance and repair costs of the side plates.

What is claimed:

1. Traveling grate apparatus for treating materials at elevated temperature, comprising a grate and upstanding substantially rectangular side plates at each side of said grate along the path of travel of the grate for cooperation with said grate to define a channel for carrying said material, each side plate having a J-shaped inner face to form a bench along the length of its inner face and intermediate the height thereof for holding material so that, as the material changes in volume during the treating, it rests on said bench and provides a seal against the passage of gases along the interface of said side plate and material.

2. The apparatus of claim 1 wherein the side plate is comprised of two portions; a substantially rectangular flat support portion out of contact with said material and a substantially rectangular partly deformed shield portion in contact with said support portion and material, said shield having a J-shaped inner face to form a bench as defined in claim 1.

3. The apparatus of claim 2 wherein the support and shield portions are separated in part by an air barrier.

4. In a traveling grate apparatus wherein a grate and side plates form a channel for carrying material, a substantially rectangular partly deformed side plate shield for substantially covering the inner surface of said side plate to protect the side plate from adverse temperature conditions, said shield having a J-shaped inner face to form a bench along the length of its inner face and intermediate height thereof for holding material so as to provide a seal against passage of gases along the side as the material tends to change in volume and leave the inner face of said shield.

* * * * *